US005252152A

United States Patent [19]

Seror

[11] Patent Number: 5,252,152

[45] Date of Patent: Oct. 12, 1993

[54] METHOD OF CONTROLLING WARPAGE IN WORKPIECE BY SELECTIVE FLAME-HARDENING AND VIBRATIONS

[75] Inventor: David J. Seror, 38200 Executive Dr. N., Westland, Mich. 48185

[73] Assignees: David J. Seror; Joseph Seror; Joseph P. Seror, all of Westland, Mich.

[21] Appl. No.: 966,536

[22] Filed: Oct. 26, 1992

[51] Int. Cl.[5] ..... G01N 29/00

[52] U.S. Cl. ..... 148/558; 73/579; 148/642; 148/645

[58] Field of Search ..... 148/558, 642, 645; 73/579

[56] References Cited

U.S. PATENT DOCUMENTS

| | | | |
|---|---|---|---|
| 2,428,827 | 10/1947 | Arnoldy | 148/642 |
| 2,783,788 | 3/1957 | Ungerer | 148/642 |
| 3,622,404 | 11/1971 | Thompson | 148/558 |
| 3,677,831 | 7/1972 | Pezaris et al. | 148/558 |
| 3,852,990 | 12/1974 | Sparling | 148/645 |
| 3,999,276 | 12/1976 | Brown et al. | 29/431 |
| 4,001,053 | 1/1977 | Igisu | 148/12.9 |
| 4,381,673 | 5/1983 | Klauba et al. | 73/579 |
| 4,968,359 | 11/1990 | Hebel, Jr. et al. | 148/12.9 |
| 5,035,142 | 7/1991 | Dryga et al. | 73/579 |

*Primary Examiner*—Upendra Roy
*Attorney, Agent, or Firm*—Charles W. Chandler

[57] ABSTRACT

A method for stress-relieving a flame-hardened component by vibrating the workpiece as it is being flame-hardened, and then vibrating the workpiece after it has been flame-hardened, measuring the workpiece to detect warpage, straightening the workpiece to remove the warpage, and then vibrating the workpiece to remove any stresses created by the straightening step.

11 Claims, 2 Drawing Sheets

METHOD OF CONTROLLING WARPAGE IN WORKPIECE BY SELECTIVE FLAME-HARDENING AND VIBRATIONS

BACKGROUND OF THE INVENTION

This invention is related to a method for flame hardening a workpiece that is a vibrated to remove stresses tending to warp the workpiece.

Components of a variety of machines require certain surfaces that are both long wearing and held to close dimensional specifications. Such surfaces may be produced by a variety of techniques, for example, by flame-hardening. However, in making certain types of workpieces such as elongated way beds, some manufacturing steps such as tempering, machining, straightening or flame-hardening step, create internal stresses that gradually warp the workpiece. Warping is undesirable.

Workpieces are measured to determine any dimensional variations from design specifications, usually noted on a blue print. They are conventionally either straightened in a press, or perhaps, machined to remove such dimensional variations. These methods are unsatisfactory because the workpiece still may tend to warp over a period of time because of stresses built into the workpiece. Sometimes the parts are tempered or treated by heat, to obtain a hard surface, but this is also undesirable because the heat may change the metallurgical structure of the workpiece.

Some vibration techniques are known in the art for removing stress from an elongated workpiece. For example, U.S. Pat. No. 3,999,276 which was issued Dec. 28, 1976 to Robert M. Brown, Melvin E. Byrne and George H. Maxwell discloses a method for raising the temperature of a railroad rail to the mean ambient temperature of the locality where the rail is being laid, and then imparting vibrations to the rail to relieve any stress or caused by the temperature change.

U.S. Pat. No. 4,001,053 which was issued Jan. 4, 1977 to Taro Igisu discloses a method for removing residual stress from a metal workpiece by a percussion vibration treatment.

U.S. Pat. No. 4,968,359 which was issued Nov. 6, 1990 to August G. Hebel, Jr., and August G. Hebel, III; U.S. Pat. No. 4,381,673 which was issued May 3, 1983 to Bruce Klauba and Roger Titone; and U.S. Pat. No. 5,035,142 which was issued Jul. 30, 1991 to Alexander I. Dryga, Nikolai A. Zadorozhny, Mikhail A. Kuzmin and Pavel M. Libman disclose various methods for stress-relieving metal parts by applying a vibrating load in frequencies determined by the harmonic vibration modes of the workpiece.

Some vibration systems for stress-relieving metal parts depend upon locating the resonant frequency of the part and then inducing vibratory forces at a frequency below resonance. Since the resonant frequency sometimes shift, it is then necessary to periodically relocate the resonant frequency and stress-relieve the part until the resonant curve stabilizes, indicating that the stresses have been relieved.

SUMMARY OF THE INVENTION

The broad purpose of the present invention is to improve the dimensional stability of metal workpieces treated by a flame-hardening process. The preferred embodiment of the invention comprises initially measuring the workpiece to determine whether its dimensions correspond to design specifications. The workpiece is bent to develop a slight bow to compensate for the stresses caused by flame hardening tending to bow the way bed in the opposite direction. The part may alternatively be vibrated to remove any stresses existing at that point.

Heat is then applied to the part in accordance with existing flame hardening practices. A vibrating device may be clamped on the workpiece to vibrate it during the flame-hardening process. The flame hardened workpiece is then removed and mounted with its ends supported on cushions. The vibrating device is then clamped on the workpiece, preferably at its midsection. However, it can be mounted at any other convenient location. The vibrating device is then energized.

A cup of water is mounted on the workpiece and the vibration energy is increased until the water jumps in the cup. The workpiece is vibrated at that frequency which may take ¾ of an hour. The water in the cup is observed until it becomes substantially still, indicating that the vibration step has been completed. The part is then checked for any warping, straightened in a press to remove any dimensional variations, and then vibrated again to remove any stresses caused by the straightening step.

It has been found that components straightened in accordance with the invention have dimensions that remain stable. Further, substantial economies in waste have been observed. The process eliminates discarding expensive way beds that have become warped beyond repair.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF A PREFERRED EMBODIMENT

Figure 1:
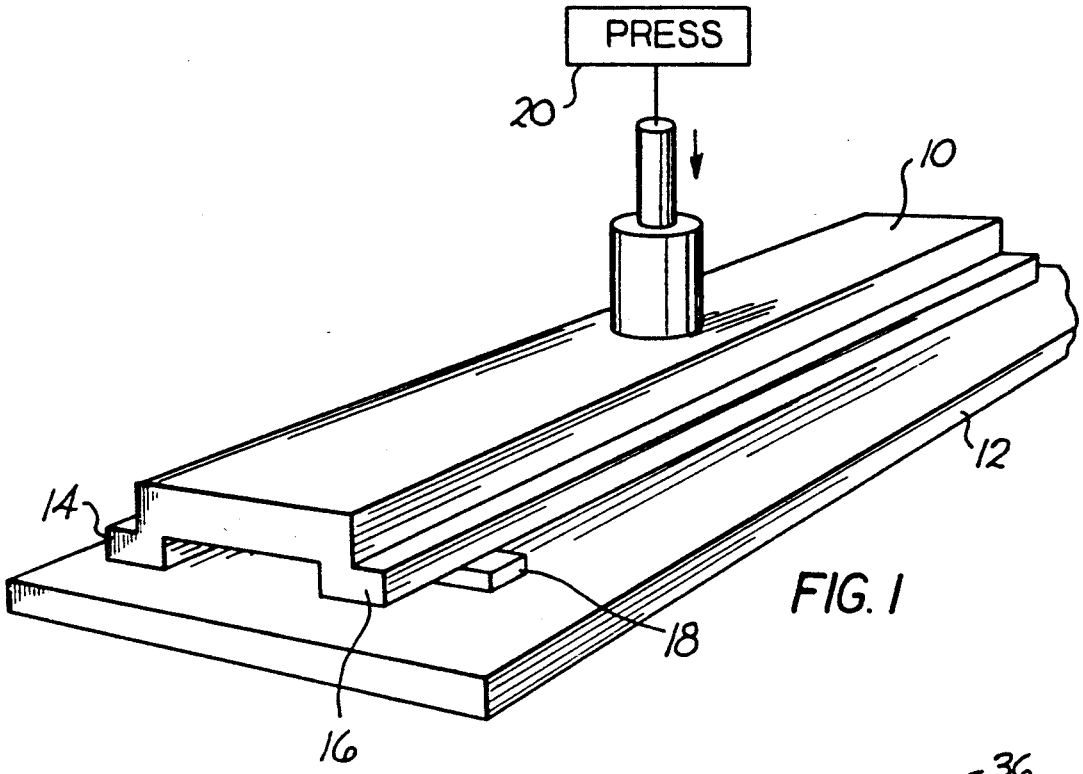
FIG. 1 illustrates an elongated way bed mounted on a table and being bent by a press to form an initial bow in the workpiece.
Figure 2:
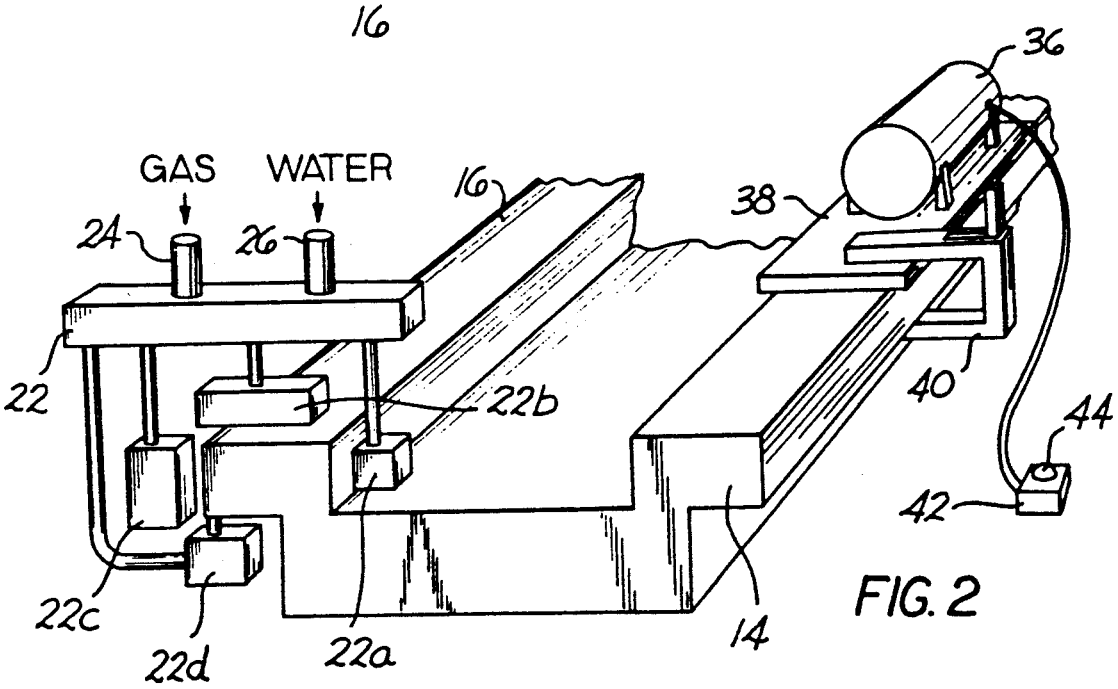
FIG. 2 illustrates a flame-hardening device advancing along the length of the way bed as it is being vibrated.

Referring to the drawings, FIG. 1 illustrates an elongated steel way bed 10 mounted on a flat steel support 12. The way bed is shown as a somewhat U-shaped configuration, including a pair of ways 14 and 16. The flatness of the workpiece is measured and compared to design specifications to determine the existence of any warpage. The way bed is then straightened so as to remove any warpage resulting from the manufacturing processes and, in addition, to apply a slightly bowed configuration. The reason is to compensate for the tendency of flame hardening along the length of the way bed to form a slight longitudinal bow.

A shim 18 is placed beneath one end of the way bed. Press means 20 then applies a downward motion on the midsection of the way bed in order to form a slight bow. The degree of bowing is determined depending upon the amount of longitudinal warpage caused by the flame-hardening step. In other words, a sufficient pre-bending is applied to cancel out any bowing caused by the flame-hardening step in the opposite direction.

In some cases, the way bed is also vibrated in a manner that will be described, prior to the flame-hardening step.

Figure 3:
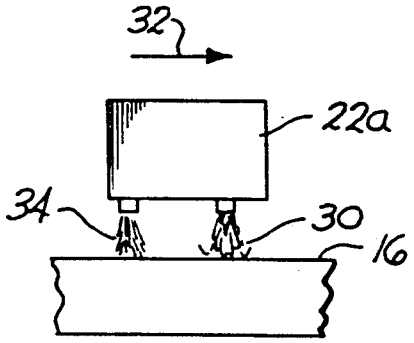
FIG. 3 is a view illustrating how the flame hardening and water quenching device heats and then cools the way bed surface.

The workpiece is then mounted in a suitable flame-hardening fixture. The flame-hardening step is achieved in the conventional manner by a flame-hardening manifold 22 which receives gas through an inlet 24 and water through an inlet 26. The water and gas are delivered through orifices 22*a*, 22*b*, 22*c* and 22*d*, each of which delivers gas toward a respective surface of the way bed. When the gas is ignited, it heats the surface, for example, to a temperature of 1600 degrees F. by a flame 30, as can be seen in FIG. 3. The manifold is gradually advanced along the length of the way bed in the direction indicated by arrow 32.

The manifold also delivers a discharge of water 34 which immediately quenches the heated surface to produce the hardening structure. This step of the flame-hardening process is old and well known in the art.

Way beds are manufactured in various sizes. A relatively large way bed is simultaneously vibrated by a vibration device 36 which is temporarily mounted on a plate 38 disposed on way bed 18. A C-shaped, clamping device 40 clamps the mounting plate on way bed 18. A control device 42 has a dial 44 for controlling the vibration frequency of device 36, which in turn, vibrates the workpiece simultaneously as the workpiece is being flame-hardened. This step also tends to remove some of the stresses built into the way bed as it is being flame-hardened.

The vibration device, for illustrative purposes, is a VIBCO S.C.R. 1,000, 115 Volt, 0–4,000 r.p.m., adjustable force vibrator, available from Vibco Inc. of Wyoming, R.I.

The way bed is vibrated for 30 minutes at 1200 lbs. force.

Figure 4:
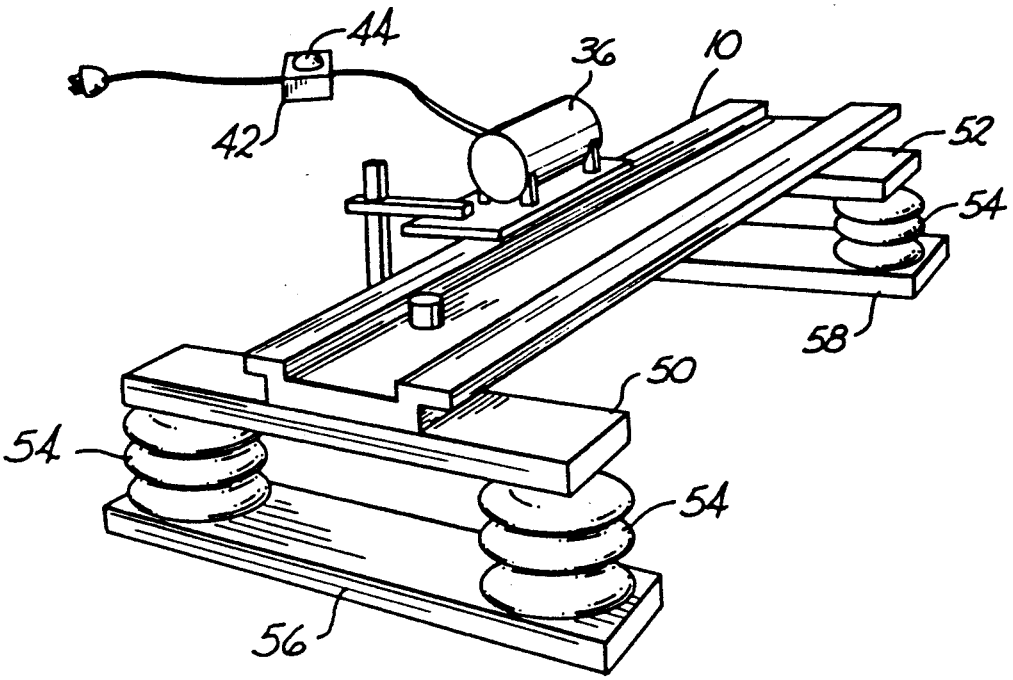
FIG. 4 is a view of the vibrating step.

Referring to FIG. 4, the way bed has its ends supported on a pair of spaced beams 50 and 52. The ends of beams 50 and 52 are mounted on cushion means 54 which are, in turn, mounted on lower beams 56 and 58. The cushion means insure that most of the vibration energy is absorbed by the workpiece. The cushion means may be formed by automotive air bag shock absorbers.

The vibration energy removes internal stresses, however, the stress removal may cause the way bed to slightly warp. The way bed is then checked against a flat surface to detect the amount of any such warpage. If the total indicated run out is unsatisfactory, the way bed is straightened and then revibrated until a satisfactory warpage variation is achieved.

Figure 5:
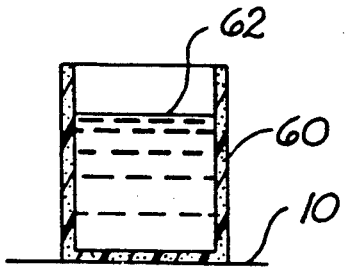
FIG. 5 illustrates a cup of water used for visually monitoring the way bed vibrations.

The vibration of the way bed is observed during the vibrating step. Referring to FIG. 5, a cup 60 of water 62 is mounted on way bed 10. The vibration energy of vibrating device 36 is increased until the water, which is about 1½ inches below the top of the cup, tends to jump out of the cup. The vibration frequency is maintained constant.

The vibration step is continued while the user observes the condition of the water level. The vibration of the water surface will gradually decrease until it is substantially static. The vibration step is then terminated. The way bed is then checked for warpage and straightened and re-vibrated until a satisfactory, minimal warpage is achieved.

The finished flame-hardened product is then shipped to the customer.

It has been found that by employing the preferred process, the resulting product has extremely stable dimensions.

Having described my invention, I claim:

1. A method for flame-hardening a metal workpiece comprising the steps of measuring the workpiece to determine the existence of any warpage;

straightening the workpiece to remove such warpage;

applying a flame to certain surfaces of the workpiece so as to heat the metal adjacent such surfaces;

immediately quenching the heated workpiece surface to increase the hardness of such surface;

supporting the workpiece on cushion means;

vibrating the workpiece;

observing the vibrations of the workpiece and terminating the vibrations after a period of time;

measuring the workpiece to determine the existence of warpage thereof;

straightening the workpiece to remove the warpage; and then repeating the vibration step.

2. A method as defined in claim 1, in which the workpiece is elongated and the flame-hardening step is generally on one side and along the length of the workpiece, and including the step of bending the workpiece prior to the flame-hardening step so that it is slightly bowed.

3. A method as defined in claim 1, in which the flame-hardening step tends to bow the workpiece in one direction transverse to its length, and in which the pre-bending step comprises bending the workpiece to form a bow in the opposite direction to off-set the bowing induced by the flame-hardening step.

4. A method as defined in claim 1, including the step of vibrating the workpiece as it is being flame-hardened.

5. A method as defined in claim 1, in which the quenching step comprises delivering water to the heated workpiece surface.

6. A method as defined in claim 1, in which the workpiece is elongated, and the workpiece is supported at its ends by longitudinally-spaced cushion supports.

7. A method as defined in claim 1, in which the vibrations are observed by placing a container of water on the workpiece and then observing the dynamic condition of the water surface produced by the vibrating means.

8. A method as defined in claim 1, including the step of vibrating the workpiece prior to the flame-hardening step.

9. A method as defined in claim 7, in which the vibration energy is increased until the water in the cup, has a dynamic condition and then the vibrations are maintained at such frequency until such time as the water becomes substantially static.

10. A method for flame-hardening a metal workpiece comprising the steps of measuring the workpiece to determine the existence of any warpage;

applying a flame to certain surfaces of the workpiece so as to heat the metal adjacent such surfaces;

immediately quenching the heated workpiece surface to increase the hardness of such surface;

supporting the workpiece on cushion means;

vibrating the workpiece;

observing the vibrations of the workpiece and terminating the vibrations after a period of time;

measuring the workpiece to determine the existence of warpage thereof;

straightening the workpiece to remove the warpage; and then repeating the vibration step.

11. A method as defined in claim 10, in which the workpiece is elongated and the flame-hardening step is generally on one side and along the length of the workpiece, and including the step of bending the workpiece prior to the flame-hardening step so that it is slightly bowed in the direction opposite to any bowing induced by the flame-hardening step.

* * * * *